US006991501B2

(12) United States Patent
Wilce

(10) Patent No.: US 6,991,501 B2
(45) Date of Patent: Jan. 31, 2006

(54) PADDLE AND METHOD OF MANUFACTURE THEREOF

(76) Inventor: Stephen E. Wilce, P.O. Box 962, Winters, CA (US) 95694

( * ) Notice: Subject to any disclaimer, the term of this patent is extended or adjusted under 35 U.S.C. 154(b) by 0 days.

(21) Appl. No.: 10/877,522

(22) Filed: Jun. 25, 2004

(65) Prior Publication Data

US 2005/0020153 A1 Jan. 27, 2005

Related U.S. Application Data

(60) Provisional application No. 60/475,462, filed on Jul. 23, 2003.

(51) Int. Cl.
*B63H 16/04* (2006.01)

(52) U.S. Cl. ..... 440/101; 416/70 R; 416/74

(58) Field of Classification Search ..... 440/101; 16/110.1; 294/57; 416/69, 70 R, 74; 473/524, 473/526, 527, 549

See application file for complete search history.

(56) References Cited

U.S. PATENT DOCUMENTS

| | | | | |
|---|---|---|---|---|
| 4,061,106 | A | 12/1977 | Ware | |
| 4,147,469 | A * | 4/1979 | Sherberne | 416/70 R |
| 4,610,633 | A | 9/1986 | Freudenberg | |
| 4,842,482 | A | 6/1989 | Beckerer, Jr. | |
| 4,955,839 | A | 9/1990 | Kaschper | |
| 6,262,141 | B1 | 7/2001 | Cywar et al. | |

* cited by examiner

*Primary Examiner*—Sherman Basinger
(74) *Attorney, Agent, or Firm*—Harris Zimmerman

(57) ABSTRACT

A paddle for a kayak, a canoe or other small boat has a shaft with a handle portion which extends from one end of a blade and a tongue portion formed by cutting away a section of the sidewall of the shaft to provide a chamber which extends along a surface of the blade. A filler member extending longitudinally within the chamber is adhered to the tongue portion of the shaft and also to the surface of the blade. This provides a light weight, high strength paddle construction which is economical to manufacture as the blade need not be formed with a bulky molded socket for enabling attachment of a shaft.

9 Claims, 3 Drawing Sheets

PADDLE AND METHOD OF MANUFACTURE THEREOF

CROSS-REFERENCE TO RELATED APPLICATION

This application claims subject matter disclosed in U.S. Provisional Application No. 60/475,462 which was filed on Jul. 23, 2003 by Stephen E. Wilce.

STATEMENT REGARDING FEDERALLY SPONSORED RESEARCH OR DEVELOPMENT (Not Applicable)

BACKGROUND OF THE INVENTION

This invention relates to paddles or oars for manually propelling and maneuvering small boats such as kayaks or canoes for example. More particularly the invention relates to a blade and shaft construction for such paddles and to methods for manufacturing paddles.

Many contemporary paddles for small watercraft are made by attaching a tubular shaft to one end of a relatively broad plastic blade. The attachment is subjected to sizable forces during use and needs to be of high strength. The common current practice is to use a molded plastic blade having an integral socket formed thereon for receiving and seating an end of the shaft. The socket adds weight to the paddle, increases inertial resistance to movement of the paddle and increases the cost of manufacture of the blade.

Small differences in weight can be of considerable significance during the use of paddles. The paddle must be repeatedly manipulated, often thousands of times during each use, and weight has a cumulative effect on the effort that is demanded of the user of the paddle.

It would be advantageous to attach the shaft to the blade of paddles in a manner which reduces weight and which does not add to the cost of manufacture by requiring a bulky and complex molded blade.

The present invention is directed to overcoming one or more of the problems discussed above.

BRIEF SUMMARY OF THE INVENTION

In one aspect of the present invention, a paddle for propelling and maneuvering a boat includes a paddle blade and a shaft having a handle portion of tubular shape which extends from a first end of the blade. An integral tongue portion of the shaft extends longitudinally from the handle portion along one of the major surfaces of the blade. The tongue portion has a curved cross section thereby forming a chamber which extends longitudinally along the major surface of the blade. A filler member extends along the surface of the blade within the chamber, the filler member being adhered to the tongue portion of the shaft and also being adhered to the surface of the blade to secure the shaft to the blade.

In another aspect of the invention a paddle for manually propelling and maneuvering a boat includes a blade having oppositely facing major surfaces and a tubular shaft having a handle portion extending from the blade at a first end thereof. A tongue portion of the shaft extends longitudinally along one of the major surfaces of said blade, the tongue portion having an elongated opening extending along a sidewall of the shaft which opening faces the surface of blade. A filler member within the tongue portion of the shaft extends along the surface of the blade at the opening. The filler member is adhered to the tongue portion of the shaft and is also adhered to the surface of the blade to secure the shaft to the blade.

In still another aspect the invention provides a method of manufacturing a paddle for use with small watercraft. Steps in the method include forming a paddle blade having oppositely facing major surfaces extending between ends of the blade. A paddle shaft is formed by cutting an opening in the sidewall of a portion of a tubular member which opening extends longitudinally along the tubular member and which extends to an end of the tubular member. This forms a tongue portion on the tubular member which tongue portion has a concave side forming an elongated chamber. A filler member is disposed in the chamber and is proportioned to extend longitudinally along the tongue portion of the shaft. The tongue portion of the shaft including the filler member is seated against one of the major surfaces of the blade. The filler member is adhered to the tongue portion of the shaft and is also adhered to the surface of the blade to secure the shaft to the blade.

Thus the invention enables economical manufacture of light weight, high strength paddles which do not require bulky blades having molded sockets for the purpose of attaching handles to the blades.

The invention, together with further objects and advantages thereof, may be further understood by reference to the following detailed description of the invention and by reference to the accompanying drawings.

DETAILED DESCRIPTION OF THE INVENTION

Figure 2:
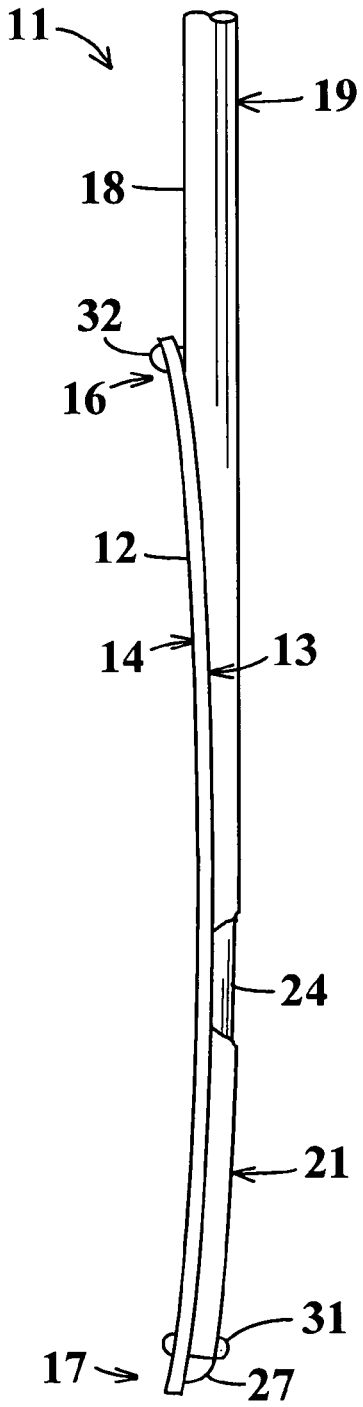
FIG. 2 is a side view of the paddle construction of FIG. 1.
Figure 1:
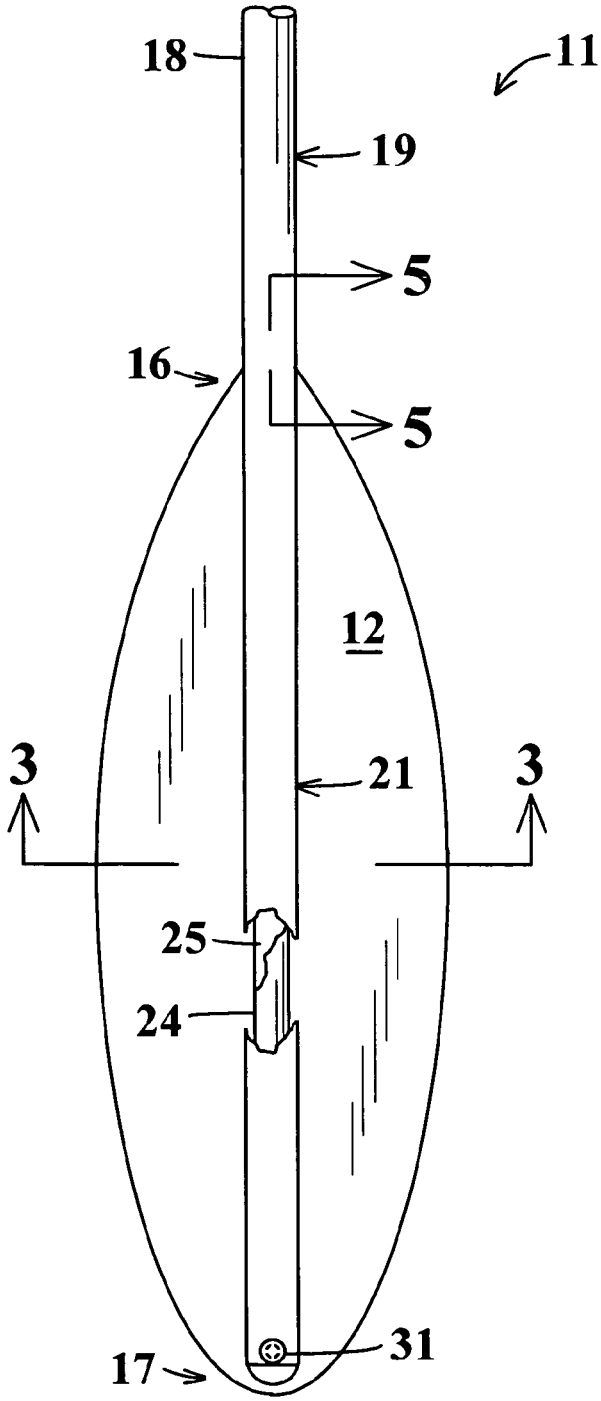
FIG. 1 is a frontal view of a paddle construction embodying a first example of the invention.

Referring to FIGS. 1 and 2 of the drawings, a paddle 11 in accordance with this embodiment of the invention has a paddle blade 12 with oppositely facing major surfaces 13 and 14 extending between first and second ends 16 and 17 of the blade. A shaft 18 extends from the first end 16 of the blade 12 to enable grasping and maneuvering of the paddle 11. The blade 12 may have any of the outlines that are customary in paddles for small watercraft such as canoes and kayaks and need not have any bulky molded protruding regions for the purpose of providing a socket for seating the shaft 18.

The blade 12 of this particular example is thermoformed from flat stock to have a slight curvature when viewed from the side but can, if desired, be a strictly flat element. The blade 12 is preferably formed of one of the light weight high strength plastics that are known to the art which in this example is ABS (acrylonitrile butadiene styrene) plastic.

Shaft 18 has a handle portion 19 which extends from end 16 of the blade 12 and which is continuous with an elongated tongue portion 21 of the shaft that extends longitudinally along the adjacent major surface 13 of the blade. The tubular handle portion 19 has a length that is dependent on the type of watercraft that the paddle 11 is to be used with. Canoe paddles, for example, are proportioned to be gripped at the distal end by one hand of the user while the other hand grips the shaft at a location which is relatively close to the blade 12. Kayak paddles are longer and have blades 12 at each end of the shaft 18 which blades may be immersed in the water, alternately, at opposite sides of the hull of the kayak. The present invention is adaptable to paddles of any of these differing types. The tubular handle portion 19 should have an end closure (not shown) at the end which is remote from blade 12 to prevent entry of water as it is desirable that paddles float if they are accidentally dropped into the water.

Shaft 18 is formed from a high strength material which in this example is aluminum tubing. The shaft 18 may also be formed from various composites such as fiberglass tubing, for example.

Figure 4:
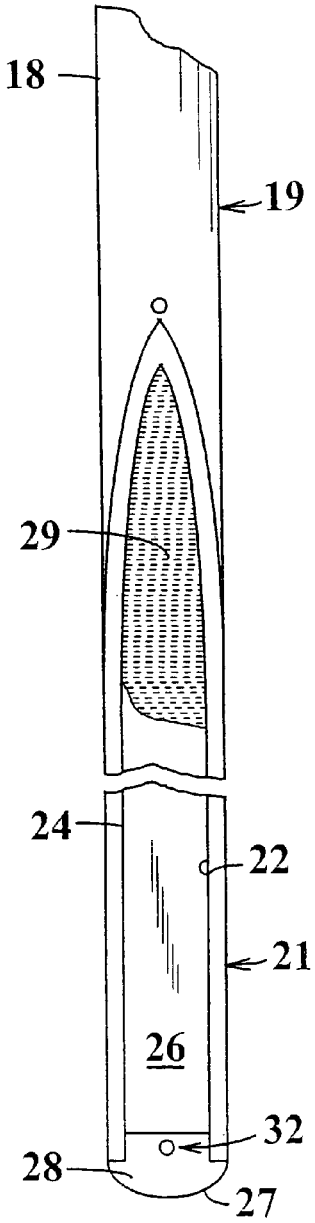
FIG. 4 is a foreshortened view of a paddle shaft component of the paddle construction of the preceding figures, the paddle shaft being shown as it appears prior to fastening of the paddle blade to the shaft.
Figure 3:
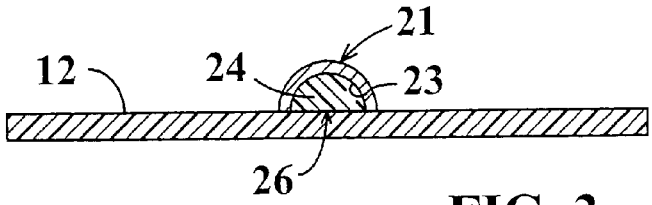
FIG. 3 is a cross section view of the paddle construction of the preceding figures taken along line 3—3 of FIG. 1.

Referring jointly to FIGS. 2, 3 and 4, the tongue portion 21 of shaft 18 is preferably of sufficient length to extend from the first end 16 of the blade 12 to a location which is adjacent to the opposite end 17 of the blade. The tongue portion 21 is formed by cutting away a strip of the sidewall of the tubing from which the shaft 18 is formed. This creates a slot opening 22 that extends longitudinally along the shaft 18 from handle portion 19 to the opposite end of the shaft. The tongue portion 21 of the shaft 18 which is formed by the cutting operation has a concave cross section and forms an elongated open chamber 23 which extends along the tongue and which is bounded on one side by the slot opening 22. Blade 12 is subsequently seated against the slot opening 22 and chamber 23. The cut which is made to form the slot opening 22 may, if necessary, have a small curvature in the region which is near the handle portion 19 to conform with curvature of the adjacent portion of blade 12 and the region of tongue portion 21 which is further away from the handle portion may be bent as may be necessary to conform with any curvature of the adjacent part of the blade. The cut which is made to form the opening 22 may be a straight cut if the blade has a strictly flat configuration.

Referring to FIGS. 1 to 4, filler member 24 is disposed within chamber 23 and has a size and shape conforming to the size and shape of the chamber. Thus the outer surface 26 of the filler member 24 is situated at the slot opening 22 and extends along the opening. The filler member 24 may be preformed and be secured to the chamber wall with an adhesive 25 after it is inserted into the chamber 23. Alternately the filler member 24 may be formed in place by filling the chamber 23 with one of the known adhesive plastic materials, such as expanding polymeric foam, which can be cured and solidified after it has been emplaced in the chamber.

The end of tongue portion 21 which is remote from the handle portion 19 is reinforced by an end cap 27 which extends a short distance into the end of chamber 23 and which has a flat surface 28 that is continuous with the outer surface 26 of filler member 24. End cap 27 provides for installation of a fastener as will hereinafter be described. In this example end cap 27 is formed of rigid PVC (polyvinyl chloride), the filler member 24 being formed from PVC foam which is cemented in place and then sanded to assure that the outer surface 26 of the filler member is flush with the edges of chamber 22. Preferably, the filler member 24 is cemented into tongue portion 21 with expanding urethane foam adhesive 25.

Blade 12 is seated against surface 24 of the filler member 14 and surface 28 of end cap 27, after an adhesive 29 is applied, to secure the blade to the shaft. The adhesive 29 in this example is an ABS and PVC compatible solvent cement although other adhesives may also be used.

Figure 5:
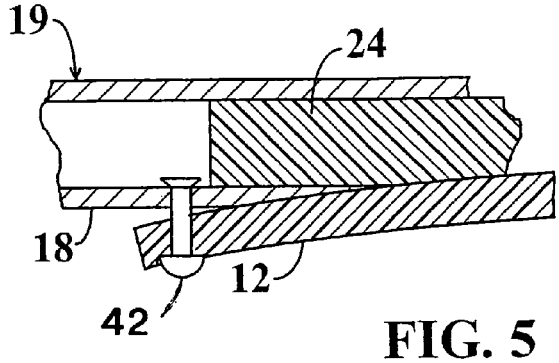
FIG. 5 is a longitudinal section view of a portion of the paddle construction of the preceding figures taken along line 5—5 of FIG. 1 and showing a rivet connection of the blade and shaft member of the paddle construction.
Figure 6:
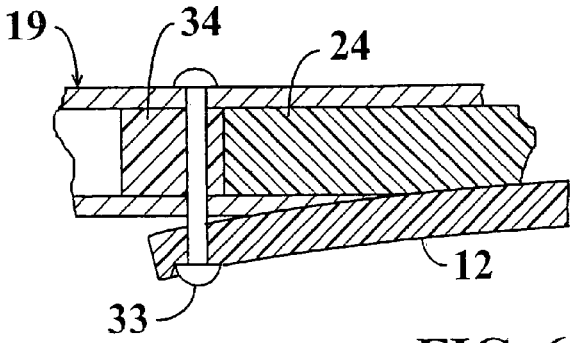
FIG. 6 is a longitudinal section view corresponding generally to FIG. 5 but showing an alternate form of rivet connection

Preferably, mechanical fasteners are provided to reinforce the attachment of the blade 12 to shaft 18. A first such fastener, which is a standard rivet 31 in this example, is implanted at an opening 32 which penetrates through the tip of tongue portion 21, end cap 27 and the blade 12. Referring to FIG. 5, a second fastener is a blind rivet 42 which extends through the blade 23 and through the adjacent wall of handle portion 19 and shaft 18 a location close to the end of blade 12. Referring to FIG. 6, the blind rivet may be replaced with another standard rivet 33 which penetrates completely through the handle portion 19 of the shaft if a rigid cylindrical fitting 34 is disposed within the handle portion at the location of the rivet 33. Fitting 34, which may be formed of rigid PVC for example, enables the tubular shaft 18 to withstand the compressive forces which are exerted during installation of a standard rivet.

Figure 7:
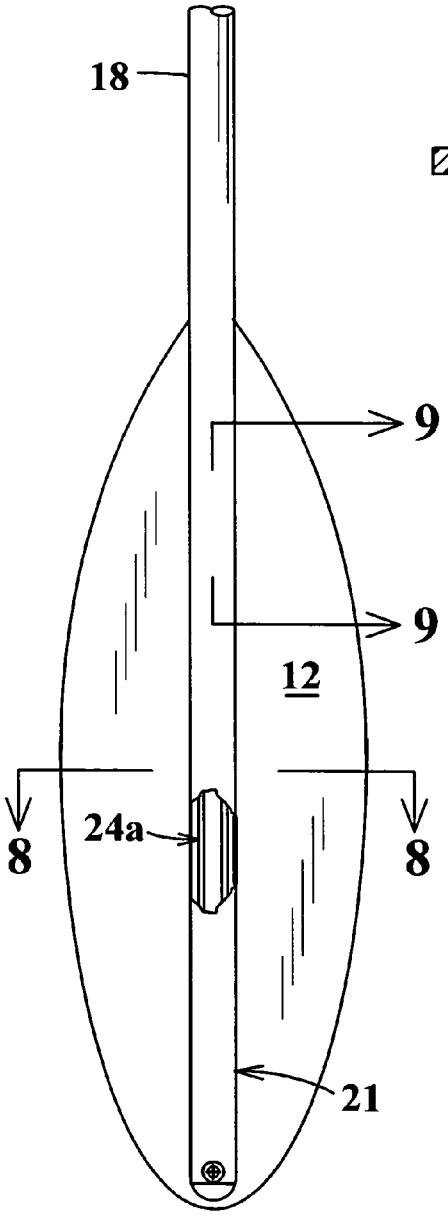
FIG. 7 is a frontal view of a paddle construction depicting a second example of the invention.
Figure 8:
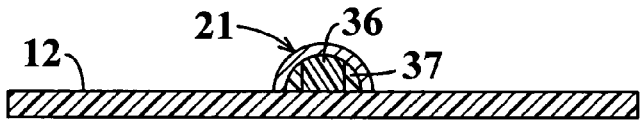
FIG. 8 is a cross section view of the paddle construction of FIG. 7 taken along line 8—8 of FIG. 7.
Figure 9:
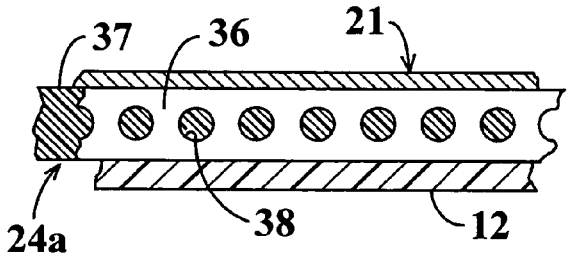
FIG. 9 is a longitudinal section view of a portion of the paddle construction of FIG. 7 taken along line 9—9 of FIG. 7

It has been pointed out that the filler member through which the blade is secured to the tubular shaft can be a preformed rigid member which is inserted into the shaft. Referring jointly to FIGS. 7, 8 and 9, the filler member 24*a* can also be a composite of two or more types of materials. In this example, the central portion of the filler member 24*a* is an insert 36 which has been preformed from solid high strength plastic. Insert 36 is shaped to extend between blade 12 and the inside wall of tongue portion 21 of shaft 18 but is not as wide as the chamber 23 which is formed by the tongue portion. The portions of chamber 23 which extend along each side of insert 36 are filled with hardenable plastic foam 37 which is cured after emplacement in the chamber. Insert 36 preferably has a series of transverse passages 38 into which the plastic foam 37 extends to interlock the two materials to each other.

Referring to the drawings in general, the invention provides for a light weight economically manufactured paddle construction as the blade 12 may be a plastic component but need not be a complex molded plastic component formed with a bulky socket for the purpose of receiving and seating a handle. In many cases, the blade can be formed from low cost plastic sheet stock. The simplified attachment of the blade and handle to each other provides a very high strength paddle and is adaptable to paddles of diverse different types.

While the invention has been described with reference to certain particular embodiments for purposes of example, many variations and modifications of the paddle construction are possible and it is not intended to limit the scope of the invention except as defined by the following claims.

What is claimed is:

1. In a paddle for propelling and maneuvering a boat, the combination comprising: a paddle blade having first and second ends and having oppositely facing major surfaces which extend therebetween, a shaft having a handle portion of tubular shape which extends from said first end of said blade and having a tongue portion which extends longitudinally from the handle portion along one of said major surfaces of said blade, said tongue portion having a curved cross section thereby forming a chamber which extends longitudinally along said one of said major surfaces of said blade, and a filler member extending along said one surface of said blade within said chamber, said filler member being adhered to said tongue portion of said shaft and being adhered to said one surface of said blade to secure said shaft to said blade, wherein said blade is plastic sheet material and said shaft is tubular metal having a cut out opening extending along a side of said tongue portion that faces said blade.

2. The combination of claim 1 wherein said filler member is formed at least in part of plastic foam which is secured to said shaft by an adhesive.

3. In a paddle for propelling and maneuvering a boat, the combination comprising: a paddle blade having first and second ends and having oppositely facing major surfaces which extend there-between, a shaft having a handle portion of tubular shape which extends from said first end of said blade and having a tongue portion which extends longitudinally from the handle portion alone one of said major surfaces of said blade, said tongue portion having a curved cross section thereby forming a chamber which extends longitudinally along said one of said major surfaces of said blade, and a filler member extending along said one surface of said blade within said chamber, said filler member being adhered to said tongue portion of said shaft and being adhered to said one surface of said blade to secure said shaft to said blade, an end closure secured to said tongue portion of said shaft at an end of said tongue portion that is remote from said handle portion of said shaft, and further including a first rivet securing said end closure to said blade.

4. The combination of claim 3 further including a second rivet securing said shaft to said blade at said first end of said blade.

5. In a paddle for propelling and maneuvering a boat, the combination comprising: a paddle blade having first and second ends and having oppositely facing major surfaces which extend there-between, a shaft having a handle portion of tubular shape which extends from said first end of said blade and having a tongue portion which extends longitudinally from the handle portion along one of said major surfaces of said blade, said tongue portion having a curved cross section thereby forming a chamber which extends longitudinally along said one of said major surfaces of said blade, and a filler member extending along said one surface of said blade within said chamber, said filler member being adhered to said tongue portion of said shaft and being adhered to said one surface of said blade to secure said shaft to said blade, wherein said filler member includes a plastic insert disposed in said chamber and extending longitudinally along said blade and further includes hardened plastic foam extending along each side of the plastic insert within said chamber.

6. In a method of manufacturing a paddle for use with small watercraft, the steps comprising: forming a paddle blade having oppositely facing major surfaces extending between first and second ends of the blade; forming a paddle shaft by cutting an opening in the sidewall of a portion of a tubular member which opening extends longitudinally along the tubular member and which extends to a first end of the tubular member thereby forming a tongue portion on the tubular member wherein the tongue portion has a concave side forming a longitudinally extending chamber; disposing a filler member in said chamber including proportioning said filler member to extend longitudinally along said tongue portion of said shaft within said chamber; adhering said filler member to said tongue portion of said shaft; seating said tongue portion of said shaft including said filler member against one of said major surfaces of said blade; and adhering said filler member to major surface of said blade to secure said shaft to said blade.

7. The method of claim 6 including proportioning said opening in said sidewall of said tubular member and proportioning said filler member to extend from a location which is adjacent to said first end of said blade to a location which is adjacent to said second end of said blade.

8. The method of claim 6 including the further steps of securing an end cap to said first end of said tongue portion of said tubular member, and securing said end cap to said blade with a fastener device.

9. The method of claim 8 including the further step of securing said tubular member to said blade with an additional fastener device located at said second end of said blade.

* * * * *